US009420677B2

(12) United States Patent
Morton et al.

(10) Patent No.: US 9,420,677 B2
(45) Date of Patent: Aug. 16, 2016

(54) X-RAY TUBE ELECTRON SOURCES

(71) Applicant: Rapiscan Systems, Inc., Torrance, CA (US)

(72) Inventors: Edward James Morton, Guildford (GB); Russell David Luggar, Dorking (GB); Paul De Antonis, Horsham (GB); Michael Cunningham, Fleet (GB)

(73) Assignee: Rapiscan Systems, Inc., Torrance, CA (US)

( * ) Notice: Subject to any disclaimer, the term of this patent is extended or adjusted under 35 U.S.C. 154(b) by 0 days.

(21) Appl. No.: 14/739,833

(22) Filed: Jun. 15, 2015

(65) Prior Publication Data

US 2015/0366041 A1 Dec. 17, 2015

Related U.S. Application Data

(63) Continuation of application No. 13/146,645, filed as application No. PCT/GB2010/050125 on Jan. 27, 2010, now Pat. No. 9,093,245.

(30) Foreign Application Priority Data

Jan. 28, 2009 (GB) ..... 0901338.4

(51) Int. Cl.

| | |
|---|---|
| ***H05G 1/32*** | (2006.01) |
| ***H01J 1/16*** | (2006.01) |
| ***H01J 35/06*** | (2006.01) |
| ***H01J 35/14*** | (2006.01) |
| ***H05G 1/60*** | (2006.01) |
| ***H05G 1/70*** | (2006.01) |

(52) U.S. Cl.

CPC .. *H05G 1/32* (2013.01); *H01J 1/16* (2013.01); *H01J 35/06* (2013.01); *H01J 35/14* (2013.01); *H05G 1/60* (2013.01); *H05G 1/70* (2013.01)

(58) Field of Classification Search

CPC ..... H01J 35/14; H01J 35/06; H01J 35/065; H01J 2235/062; H01J 1/304; H01J 2201/30469; H01J 9/025; H01J 35/02

See application file for complete search history.

(56) References Cited

U.S. PATENT DOCUMENTS

| | | | |
|---|---|---|---|
| 2,101,143 | A | 12/1937 | Laidig |
| 2,333,525 | A | 11/1943 | Cox |
| 2,842,694 | A | 7/1958 | Hosemann |
| 2,952,790 | A | 9/1960 | Steen |
| 3,138,729 | A | 6/1964 | Henke |

(Continued)

FOREIGN PATENT DOCUMENTS

| | | | |
|---|---|---|---|
| CN | 1138743 | A | 12/1996 |
| CN | 1172952 | A | 2/1998 |

(Continued)

OTHER PUBLICATIONS

US 5,987,079, 11/1999, Scott. (withdrawn).

(Continued)

*Primary Examiner* — Hoon Song
(74) *Attorney, Agent, or Firm* — Novel IP

(57) ABSTRACT

An electron source for an X-ray scanner includes an emitter support block, an electron-emitting region formed on the support block and arranged to emit electrons, an electrical connector arranged to connect a source of electric current to the electron-emitting region, and heating structure arranged to heat the support block.

10 Claims, 6 Drawing Sheets

(56) References Cited

U.S. PATENT DOCUMENTS 3,239,706 A 3/1966 Farrell
3,610,994 A 10/1971 Sheldon
3,768,645 A 10/1973 Conway
3,867,637 A 2/1975 Braun
4,045,672 A 8/1977 Watanabe
4,057,725 A 11/1977 Wagner
4,064,411 A 12/1977 Iwasaki
4,105,922 A 8/1978 Lambert
4,165,472 A 8/1979 Wittry
4,171,254 A 10/1979 Koenecke
4,228,353 A 10/1980 Johnson
4,238,706 A 12/1980 Yoshihara
4,241,404 A 12/1980 Lux
4,259,721 A 3/1981 Kuznia
4,266,425 A 5/1981 Allport
4,274,005 A 6/1981 Yamamura
4,309,637 A 1/1982 Fetter
4,340,816 A 7/1982 Schott
4,344,011 A 8/1982 Hayashi
4,352,021 A 9/1982 Boyd
4,352,196 A 9/1982 Gabbay
4,405,876 A 9/1983 Iversen
4,420,382 A 12/1983 Riedl
4,461,020 A 7/1984 Hubner
4,468,802 A 8/1984 Friedel
4,531,226 A 7/1985 Peschmann
4,622,687 A 11/1986 Whitaker
4,625,324 A 11/1986 Blaskis
4,670,895 A 6/1987 Penato
4,672,649 A 6/1987 Rutt
4,675,890 A 6/1987 Plessis
4,677,651 A 6/1987 Hartl
4,719,645 A 1/1988 Yamabe
4,736,400 A 4/1988 Koller
4,763,345 A 8/1988 Barbaric
RE32,961 E 6/1989 Wagner
4,866,745 A 9/1989 Akai
4,868,856 A 9/1989 Frith
4,887,604 A 12/1989 Shefer
4,894,775 A 1/1990 Kritchman
4,928,296 A 5/1990 Kadambi
4,945,562 A 7/1990 Staub
4,991,194 A 2/1991 Laurent
5,018,181 A 5/1991 Iversen
5,033,106 A 7/1991 Kita
5,056,127 A 10/1991 Iversen
5,065,418 A 11/1991 Bermbach
5,068,882 A 11/1991 Eberhard
5,073,910 A 12/1991 Eberhard
5,091,924 A 2/1992 Bermbach
5,091,927 A 2/1992 Golitzer
5,138,308 A 8/1992 Clerc
5,144,191 A 9/1992 Jones et al.
5,159,234 A 10/1992 Wegmann
5,191,600 A 3/1993 Vincent
5,195,112 A 3/1993 Vincent
5,247,556 A 9/1993 Eckert
5,259,014 A 11/1993 Brettschneider
5,268,955 A 12/1993 Burke
5,272,627 A 12/1993 Maschhoff
5,305,363 A 4/1994 Burke
5,313,511 A 5/1994 Annis
5,329,180 A 7/1994 Popli
5,367,552 A 11/1994 Peschmann
5,375,156 A 12/1994 Kuo-Petravic
5,414,622 A 5/1995 Walters
5,467,377 A 11/1995 Dawson
5,511,104 A 4/1996 Mueller
5,515,414 A 5/1996 dAchardVanEnschut
5,541,975 A 7/1996 Anderson
5,568,829 A 10/1996 Crawford
5,596,621 A 1/1997 Schwarz
5,600,700 A 2/1997 Krug
5,604,778 A 2/1997 Polacin
5,616,926 A * 4/1997 Shinada ..... H01J 1/304 250/423 F
5,633,907 A 5/1997 Gravelle
5,654,995 A 8/1997 Flohr
5,680,432 A 10/1997 Voss
5,689,541 A 11/1997 Schardt
5,712,889 A 1/1998 Lanzara
5,798,972 A 8/1998 Lao
5,841,831 A 11/1998 Hell
5,859,891 A 1/1999 Hibbard
5,879,807 A 3/1999 Inoue
5,889,833 A 3/1999 Silver
5,907,593 A 5/1999 Hsieh
5,966,422 A 10/1999 Dafni
5,974,111 A 10/1999 Krug
5,987,097 A 11/1999 Salasoo
6,014,419 A 1/2000 Hu
6,018,562 A 1/2000 Willson
6,075,836 A 6/2000 Ning
6,088,426 A 7/2000 Miller
6,108,575 A 8/2000 Besson
6,122,343 A 9/2000 Pidcock
6,130,502 A 10/2000 Kobayashi
6,181,765 B1 1/2001 Sribar
6,183,139 B1 2/2001 Solomon
6,188,747 B1 2/2001 Geus
6,218,943 B1 4/2001 Ellenbogen
6,229,870 B1 5/2001 Morgan
6,236,709 B1 5/2001 Perry
6,240,157 B1 5/2001 Danielsson
6,269,142 B1 7/2001 Smith
6,298,110 B1 10/2001 Ning
6,324,243 B1 11/2001 Edic
6,324,249 B1 11/2001 Fazzio
6,341,154 B1 1/2002 Besson
6,404,230 B1 6/2002 Cairns
6,430,260 B1 8/2002 Snyder
6,449,331 B1 9/2002 Nutt
6,470,065 B1 10/2002 Lauther
6,480,571 B1 11/2002 Andrews
6,546,072 B1 4/2003 Chalmers
6,553,096 B1 4/2003 Zhou
6,556,653 B2 4/2003 Hussein
6,580,780 B1 6/2003 Miller
6,624,425 B2 9/2003 Nisius
6,674,838 B1 1/2004 Barrett
6,735,271 B1 5/2004 Rand et al.
6,751,293 B1 6/2004 Barrett
6,760,407 B2 7/2004 Price et al.
6,785,359 B2 8/2004 Lemaitre
6,819,742 B1 11/2004 Miller
6,975,703 B2 12/2005 Wilson et al.
6,993,115 B2 1/2006 McGuire et al.
7,079,624 B1 7/2006 Miller
7,184,520 B1 2/2007 Sano
7,192,031 B2 3/2007 Dunham et al.
7,197,116 B2 3/2007 Dunham
7,203,269 B2 4/2007 Huber
7,203,282 B2 4/2007 Brauss
7,218,700 B2 5/2007 Huber et al.
7,233,644 B1 6/2007 Bendahan
7,248,673 B2 7/2007 Miller
7,349,525 B2 3/2008 Morton
7,466,799 B2 12/2008 Miller
7,508,916 B2 3/2009 Frontera
7,664,230 B2 2/2010 Morton
7,697,665 B2 4/2010 Yonezawa
7,728,397 B2 6/2010 Gorrell
7,738,632 B2 6/2010 Popescu
8,094,784 B2 1/2012 Morton
8,243,876 B2 8/2012 Morton
8,331,535 B2 12/2012 Morton
8,654,924 B2 2/2014 Behling
2001/0022346 A1 9/2001 Katagami et al.
2001/0033635 A1 10/2001 Kuwabara
2002/0031202 A1 3/2002 Callerame
2002/0082492 A1 6/2002 Grzeszczuk
2002/0094064 A1 7/2002 Zhou
2002/0097836 A1 7/2002 Grodzins

(56) References Cited

U.S. PATENT DOCUMENTS

| | | | | |
|---|---|---|---|---|
| 2002/0140336 | A1 | 10/2002 | Stoner | |
| 2002/0176531 | A1 | 11/2002 | McClelland | |
| 2003/0021377 | A1 | 1/2003 | Turner et al. | |
| 2003/0031352 | A1 | 2/2003 | Nelson et al. | |
| 2003/0043957 | A1 | 3/2003 | Pelc | |
| 2003/0048868 | A1 | 3/2003 | Bailey | |
| 2003/0076921 | A1 | 4/2003 | Mihara | |
| 2003/0076924 | A1 | 4/2003 | Mario | |
| 2003/0091148 | A1 | 5/2003 | Bittner | |
| 2004/0021623 | A1 | 2/2004 | Nicolas | |
| 2004/0022292 | A1 | 2/2004 | Morton | |
| 2004/0057554 | A1 | 3/2004 | Bjorkholm | |
| 2004/0066879 | A1 | 4/2004 | Machida | |
| 2004/0094064 | A1 | 5/2004 | Taguchi | |
| 2004/0120454 | A1 | 6/2004 | Ellenbogen et al. | |
| 2004/0202282 | A1 | 10/2004 | Miller | |
| 2004/0213378 | A1 | 10/2004 | Zhou et al. | |
| 2004/0252807 | A1 | 12/2004 | Skatter | |
| 2004/0258305 | A1 | 12/2004 | Burnham | |
| 2005/0002492 | A1 | 1/2005 | Rother | |
| 2005/0031075 | A1 | 2/2005 | Hopkins | |
| 2005/0053189 | A1 | 3/2005 | Gohno | |
| 2005/0058242 | A1 | 3/2005 | Peschmann | |
| 2005/0100135 | A1 | 5/2005 | Lowman | |
| 2005/0105682 | A1 | 5/2005 | Heumann | |
| 2005/0111610 | A1 | 5/2005 | DeMan | |
| 2005/0123092 | A1 | 6/2005 | Mistretta | |
| 2005/0157925 | A1 | 7/2005 | Lorenz | |
| 2005/0175151 | A1 | 8/2005 | Dunham | |
| 2005/0276377 | A1 | 12/2005 | Carol | |
| 2005/0276382 | A1 | 12/2005 | Lesiak | |
| 2006/0050842 | A1 | 3/2006 | Wang | |
| 2006/0233297 | A1 | 10/2006 | Ishiyama | |
| 2007/0053495 | A1 | 3/2007 | Morton et al. | |
| 2007/0064873 | A1 | 3/2007 | Gabioud | |
| 2007/0172023 | A1 | 7/2007 | Morton | |
| 2007/0183575 | A1 | 8/2007 | Lemaitre | |
| 2007/0297570 | A1 | 12/2007 | Kerpershoek | |
| 2008/0019483 | A1 | 1/2008 | Andrews | |
| 2008/0043920 | A1 | 2/2008 | Liu | |
| 2008/0056436 | A1 | 3/2008 | Pack | |
| 2008/0056437 | A1 | 3/2008 | Pack | |
| 2008/0069420 | A1* | 3/2008 | Zhang | A61B 6/00 382/132 |
| 2008/0112540 | A1 | 5/2008 | Rogers | |
| 2008/0123803 | A1 | 5/2008 | DeMan | |
| 2008/0130974 | A1 | 6/2008 | Xu | |
| 2009/0022264 | A1 | 1/2009 | Zhou | |
| 2009/0097836 | A1 | 4/2009 | Tanaka | |
| 2009/0159451 | A1 | 6/2009 | Tomantschger | |
| 2009/0185660 | A1 | 7/2009 | Zou | |
| 2010/0046716 | A1 | 2/2010 | Freudenberger | |
| 2010/0111265 | A1 | 5/2010 | Holm | |
| 2010/0246754 | A1 | 9/2010 | Morton | |
| 2010/0316192 | A1 | 12/2010 | Hauttmann | |
| 2011/0007876 | A1 | 1/2011 | Morton | |
| 2011/0188725 | A1 | 8/2011 | Yu | |
| 2011/0222662 | A1 | 9/2011 | Behling | |
| 2013/0156161 | A1 | 6/2013 | Andrews | |
| 2013/0195253 | A1 | 8/2013 | Andrews | |

FOREIGN PATENT DOCUMENTS

| | | | |
|---|---|---|---|
| CN | 1194718 | | 9/1998 |
| CN | 1795527 | A | 6/2006 |
| DE | 2729353 | A1 | 1/1979 |
| DE | 3638378 | | 5/1988 |
| DE | 3840398 | A1 | 6/1989 |
| DE | 4432205 | C1 | 1/1996 |
| DE | 4425691 | A1 | 2/1996 |
| DE | 19745998 | A1 | 3/1999 |
| DE | 10036210 | A1 | 11/2001 |
| DE | 10319547 | | 11/2004 |
| DE | 10319549 | B3 | 12/2004 |
| EP | 0142249 | A2 | 5/1985 |
| EP | 0432568 | | 6/1991 |
| EP | 0531993 | A1 | 3/1993 |
| EP | 0584871 | A1 | 3/1994 |
| EP | 0924742 | A2 | 6/1999 |
| EP | 0930046 | A2 | 7/1999 |
| EP | 1277439 | A1 | 1/2003 |
| EP | 1374776 | A1 | 1/2004 |
| EP | 1558142 | A1 | 8/2005 |
| FR | 2328280 | A1 | 5/1977 |
| FR | 2675629 | A1 | 10/1992 |
| GB | 1149796 | A | 4/1969 |
| GB | 1272498 | A | 4/1972 |
| GB | 1497396 | A | 1/1978 |
| GB | 1526041 | A | 9/1978 |
| GB | 2015245 | A | 9/1979 |
| GB | 2089109 | A | 6/1982 |
| GB | 2212903 | A | 8/1989 |
| GB | 2212975 | A | 8/1989 |
| GB | 2360405 | | 9/2001 |
| GB | 2360405 | A | 9/2001 |
| GB | 2418529 | A | 3/2006 |
| JP | 50081080 | A | 7/1975 |
| JP | S51055286 | | 5/1976 |
| JP | S51078696 | | 7/1976 |
| JP | S52050186 | | 4/1977 |
| JP | S52124890 | | 10/1977 |
| JP | S5493993 | | 7/1979 |
| JP | S55046408 | | 4/1980 |
| JP | 56086448 | | 7/1981 |
| JP | S56167464 | | 12/1981 |
| JP | S5717524 | A | 1/1982 |
| JP | S57110854 | | 7/1982 |
| JP | 570175247 | | 10/1982 |
| JP | S57175247 | A | 10/1982 |
| JP | 58212045 | A | 12/1983 |
| JP | 590016254 | A | 1/1984 |
| JP | S591625 | A | 1/1984 |
| JP | S5916254 | A | 1/1984 |
| JP | 59075549 | | 4/1984 |
| JP | S5975549 | A | 4/1984 |
| JP | 600015546 | | 1/1985 |
| JP | S601554 | A | 1/1985 |
| JP | S602144 | | 1/1985 |
| JP | 600021440 | | 2/1985 |
| JP | S6038957 | A | 2/1985 |
| JP | S60181851 | | 12/1985 |
| JP | 61107642 | | 5/1986 |
| JP | 62044940 | A | 2/1987 |
| JP | S62121773 | | 8/1987 |
| JP | 63016535 | | 1/1988 |
| JP | 1296544 | A | 11/1989 |
| JP | 03198975 | | 8/1991 |
| JP | H0479128 | A | 3/1992 |
| JP | H04319237 | | 11/1992 |
| JP | H05135721 | A | 6/1993 |
| JP | H05182617 | A | 7/1993 |
| JP | H05290768 | A | 11/1993 |
| JP | 060038957 | | 2/1994 |
| JP | H0638957 | A | 2/1994 |
| JP | 06162974 | | 6/1994 |
| JP | H06261895 | | 9/1994 |
| JP | H07093525 | | 4/1995 |
| JP | H09171788 | | 6/1997 |
| JP | H10211196 | A | 8/1998 |
| JP | H10272128 | | 10/1998 |
| JP | H11500229 | | 1/1999 |
| JP | H11273597 | | 10/1999 |
| JP | 2000175895 | | 6/2000 |
| JP | 2001023557 | | 1/2001 |
| JP | 2001502473 | | 2/2001 |
| JP | 2001176408 | A | 6/2001 |
| JP | 2001204723 | | 7/2001 |
| JP | 2002343291 | | 11/2002 |
| JP | 2003092076 | | 3/2003 |
| JP | 2003121392 | | 4/2003 |
| JP | 2003126075 | A | 5/2003 |
| JP | 2003257347 | | 9/2003 |
| JP | 2004000605 | A | 1/2004 |

(56) References Cited

FOREIGN PATENT DOCUMENTS

| | | | |
|---|---|---|---|
| JP | 2004079128 | A | 3/2004 |
| JP | 2004311245 | | 11/2004 |
| JP | 2005013768 | A | 1/2005 |
| JP | 2006128137 | | 5/2006 |
| JP | 2006351272 | A | 12/2006 |
| JP | 2007265981 | | 10/2007 |
| JP | 2008166059 | A | 7/2008 |
| JP | 2010060572 | | 3/2010 |
| JP | 100211196 | | 9/2010 |
| SU | 1022236 | A1 | 6/1983 |
| WO | 9528715 | A2 | 10/1995 |
| WO | 9718462 | A1 | 5/1997 |
| WO | 9960387 | A2 | 11/1999 |
| WO | 0231857 | | 4/2002 |
| WO | 03051201 | A2 | 6/2003 |
| WO | 2004010127 | | 1/2004 |
| WO | 2004042769 | A1 | 5/2004 |
| WO | 2004097386 | A1 | 11/2004 |
| WO | 2004097888 | A2 | 11/2004 |
| WO | 2004097889 | A2 | 11/2004 |
| WO | 2006130630 | | 12/2006 |
| WO | 2006130630 | A2 | 12/2006 |
| WO | 2007068933 | | 6/2007 |
| WO | 2008068691 | | 6/2008 |
| WO | 2009012453 | | 1/2009 |
| WO | 2009012453 | A1 | 1/2009 |
| WO | 2010007375 | A2 | 1/2010 |
| WO | 2010086653 | | 8/2010 |
| WO | 2010141659 | A1 | 12/2010 |

OTHER PUBLICATIONS

Notice of Allowance dated Mar. 19, 2015 for U.S. Appl. No. 13/146,645.
Office Action dated Nov. 26, 2014 for U.S. Appl. No. 13/146,645.
STMicroelectronics, "Dual Full-Bridge Driver", Datasheet for L298, 2000, pp. 1-13, XP002593095.
STMicroelectronics: "Dual Full-Bridge Driver", Datasheet for L298, 2000, pp. 1-13, XP002593095.
Extended European Search Report for EP15174771, CXR Limited, Sep. 18, 2015.
International Search Report, PCT/GB2004/001729, Aug. 12, 2004, Rapiscan Systems, Inc.
International Search Report, PCT/GB2004/001732, Feb. 25, 2005.
Bruder et al. "Efficient Extended Field of View (eFOV) Reconstructuion Techniques for Multi-Slice Helical CT", Medical Imaging 2008: Physics of Medical Imaging, edited by Jiang Hsieh, Ehsan Samei, Proc. of SPIE vol. 6913, 69132E, (2008).
Chinese Patent Application No. 200980114807.X, Second Office Action, Nov. 21, 2013.
European Search Opinion, EP10784058, Dec. 18, 2013.
Great Britain Patent Application No. GB0816823.9, Search Report, Oct. 20, 2009.
Great Britain Patent Application No. GB1104148.0, Examination Report, Mar. 29, 2011.
International Search Report, PCT/GB2004/001731, May 27, 2005.
International Search Report, PCT/GB2004/001741, Mar. 3, 2005.
International Search Report, PCT/GB2004/001747, Aug. 10, 2004.
International Search Report, PCT/GB2004/001751, Mar. 21, 2005.
International Search Report, PCT/GB2009/001760, Mar. 1, 2010, Rapiscan Systems, Inc.
International Search Report, PCT/US2010/41871, Jan. 20, 2011, Rapiscan Systems, Inc.
International Search Report for PCT/US2010/037167, Sep. 7, 2010.
Notice of Allowance dated Dec. 4, 2014 for U.S. Appl. No. 13/313,854.
Notice of Allowance dated Jan. 30, 2015 for U.S. Appl. No. 13/405,117.
Office Action dated Apr. 17, 2015 for U.S. Appl. No. 13/054,066.
Office Action dated Jan. 3, 2014 for U.S. Appl. No. 13/054,066.
Office Action dated Oct. 21, 2014 for U.S. Appl. No. 13/674,086.
Office Action dated Oct. 30, 2014 for U.S. Appl. No. 13/054,066.
Second office action for Japanese Application No. JP2012-514109 mailed on Oct. 20, 2014.
Supplementary European Search Report, EP10784058, Dec. 6, 2013.
Notice of Allowance dated Oct. 6, 2015 for U.S. Appl. No. 13/054,666.
Notice of Allowance dated Aug. 3, 2015 for U.S. Appl. No. 13/674,086.
Office Action dated Mar. 17, 2015 for U.S. Appl. No. 13/674,086.
International Search Report, PCT/US2010/37167, Dec. 9, 2010, Rapiscan Security Products, Inc.
International Search Report, PCT/US2012/40923, Sep. 12, 2012, Rapiscan Systems, Inc.
European Search Report for EP 15174778, CXR Limited, completed on Sep. 18, 2015.
European Search Report for EP 15174778, CXR Limited, dated Oct. 15, 2015.
Examination Report for GB1120237.1, dated Aug. 13, 2015.
Communication Pursuant to Article 94(3) EPC for EP10784058, Aug. 21, 2015.
Office Action for Japanese Patent Application No. 2015-515989, Nov. 19, 2015.
Notification of Reexamination for Chinese Patent Application No. CN200980144807X, dated Oct. 12, 2015.
Keevil, S.V., Lawinski, C.P. and Morton, E.J., 1987, "Measurement of the performance characteristics of anti-scatter grids.", Phys. Med. Biol., 32(3), 397-403.
Morton, E.J., Webb, S., Bateman, J.E., Clarke, L.J. and Shelton, C.G., 1990, "Three-dimensional x-ray micro-tomography for medical and biological applications.", Phys. Med. Biol., 35(7), 805-820.
Morton, E.J., Swindell, W., Lewis, D.G. and Evans, P.M., 1991, "A linear array scintillation-crystal photodiode detector for megavoltage imaging.", Med. Phys., 18(4), 681-691.
Morton, E.J., Lewis, D.G. and Swindell, W., 1988, "A method for the assessment of radiotherapy treatment precision", Brit. J. Radiol., Supplement 22, 25.
Swindell, W., Morton, E.J., Evans, P.M. and Lewis, D.G., 1991, "The design of megavoltage projection imaging systems: some theoretical aspects.", Med. Phys.,18(5), 855-866.
Morton, E.J., Evans, P.M., Ferraro, M., Young, E.F. and Swindell, W., 1991, "A video frame store facility for an external beam radiotherapy treatment simulator.", Brit. J. Radiol., 64, 747-750.
Antonuk, L.E., Yorkston, J., Kim, C.W., Huang, W., Morton, E.J., Longo, M.J. and Street, R.A., 1991, "Light response characteristics of amorphous silicon arrays for megavoltage and diagnostic imaging.", Mat. Res. Soc. Sym. Proc., 219, 531-536.
Yorkston, J., Antonuk, L.E., Morton, E.J., Boudry, J., Huang, W., Kim, C.W., Longo, M.J. and Street, R.A., 1991, "The dynamic response of hydrogenated amorphous silicon imaging pixels.", Mat. Res. Soc. Sym. Proc., 219, 173-178.
Evans, P.M., Gildersleve, J.Q., Morton, E.J., Swindell, W., Coles, R., Ferraro, M., Rawlings, C., Xiao, Z.R. and Dyer, J., 1992, "Image comparison techniques for use with megavoltage imaging systems.", Brit. J. Radiol., 65, 701-709.
Morton, E.J., Webb, S., Bateman, J.E., Clarke, L.J. and Shelton, C.G., 1989, "The development of 3D x-ray micro-tomography at sub 100 μm resolution with medical, industrial and biological applications.", Presentation at IEE colloquium "Medical scanning and imaging techniques of value in non-destructive testing" , London, Nov. 3, 1989.
Antonuk, L.E., Boudry, J., Huang, W., McShan, D.L., Morton, E.J., Yorkston, J, Longo, M.J. and Street, R.A., 1992, "Demonstration of megavoltage and diagnostic x-ray imaging with hydrogenated amorphous silicon arrays.", Med. Phys., 19(6), 1455-1466.
Gildersleve, J.Q., Swindell, W., Evans, P.M., Morton, E.J., Rawlings, C. and Dearnaley, D.P., 1991, "Verification of patient positioning during radiotherapy using an integrated megavoltage imaging system.", in "Tumour Response Monitoring and Treatment Planning", Proceedings of the International Symposium of W. Vaillant Foundation on Advanced Radiation Therapy, Munich, Germany, Ed A. Breit (Berlin: Springer), 693-695.
Lewis, D.G., Evans, P.M., Morton, E.J., Swindell, W. and Xiao, X.R., 1992, "A megavoltage CT scanner for radiotherapy verification.", Phys. Med. Biol., 37, 1985-1999.

(56) References Cited

OTHER PUBLICATIONS

Antonuk, L.E., Boudry, J., Kim, C.W., Longo, M.J., Morton, E.J., Yorkston, J. and Street, R.A., 1991, "Signal, noise and readout considerations in the development of amorphous silicon photodiode arrays for radiotherapy and diagnostic x-ray imaging.", SPIE vol. 1443 Medical Imaging V: Image Physics, 108-119.

Antonuk, L.E., Yorkston, J., Huang, W., Boudry, J., Morton, E.J., Longo, M.J. and Street, R.A., 1992, "Radiation response characteristics of amorphous silicon arrays for megavoltage radiotherapy imaging.", IEEE Trans. Nucl. Sci., 39,1069-1073.

Antonuk, L.E., Yorkston, J., Huang, W., Boudry, J., Morton, E.J., Longo, M.J. and Street, R.A., 1992, "Factors affecting image quality for megavoltage and diagnostic x-ray a-Si:H imaging arrays.", Mat. Res. Soc. Sym. Proc., 258, 1069-1074.

Antonuk, L.E., Boudry, J., Yorkston, J., Morton, E.J., Huang, W. and Street, R.A., 1992, "Development of thin-film, flat-panel arrays for diagnostic and radiotherapy imaging.", SPIE vol. 1651, Medical Imaging VI: Instrumentation, 94-105.

Yorkston, J., Antonuk, L.E., Seraji, N., Boudry, J., Huang, W., Morton, E.J., and Street, R.A., 1992, "Comparison of computer simulations with measurements from a-Si:H imaging arrays.", Mat. Res. Soc. Sym. Proc., 258, 1163-1168.

Morton, E.J., Antonuk, L.E., Berry, J.E., Boudry, J., Huang, W., Mody, P., Yorkston, J. and Longo, M.J., 1992, "A CAMAC based data acquisition system for flat-panel image array readout" , Presentation at IEEE Nuclear Science Symposium, Orlando, Oct. 25-31, 1992.

Antonuk, L.E., Yorkston, J., Huang, W., Boudry, J., Morton, E.J. and Street, R.A., 1993, "Large area, flat-panel a-Si:H arrays for x-ray imaging.", SPIE vol. 1896, Medical Imaging 1993: Physics of Medical Imaging, 18-29.

Morton, E.J., Antonuk, L.E., Berry, J.E., Huang, W., Mody, P. and Yorkston, J., 1994, "A data acquisition system for flat-panel imaging arrays", IEEE Trans. Nucl. Sci., 41(4), 1150-1154.

Antonuk, L.E., Boudry, J., Huang, W., Lam, K.L., Morton, E.J., TenHaken, R.K., Yorkston, J. and Clinthorne, N.H., 1994, "Thin-film, flat-panel, composite imagers for projection and tomographic imaging", IEEE Trans. Med. Im., 13(3), 482-490.

Gildersleve, J., Dearnaley, D., Evans, P., Morton, E.J. and Swindell, W., 1994, "Preliminary clinical performance of a scanning detector for rapid portal imaging", Clin. Oncol., 6, 245-250.

Hess, R., De Antonis, P., Morton, E.J. and Gilboy, W.B., 1994, "Analysis of the pulse shapes obtained from single crystal CdZnTe radiation detectors", Nucl. Inst. Meth., A353, 76-79.

DeAntonis, P., Morton, E.J., T. Menezes, 1996, "Measuring the bulk resistivity of CdZnTe single crystal detectors using a contactless alternating electric field method", Nucl. Inst. Meth., A380, 157-159.

DeAntonis, P., Morton, E.J., Podd, F., 1996, "Infra-red microscopy of CdZnTe radiation detectors revealing their internal electric field structure under bias", IEEE Trans. Nucl. Sci., 43(3), 1487-1490.

Tavora, L.M.N., Morgado, R.E., Estep, R.J., Rawool-Sullivan, M., Gilboy, W.B. and Morton, E.J., 1998, "One-sided imaging of large, dense, objects using the 511 keV photons from induced pair production" , IEEE Trans. Nucl. Sci., 45(3), 970-975.

Morton, E.J., 1995, "Archaeological potential of computerised tomography" , Presentation at IEE Colloquium on "NDT in archaeology and art" , London, May 25, 1995.

Tavora, L.M.N. and Morton, E.J., 1998, "Photon production using a low energy electron expansion of the EGS4 code system ", Nucl. Inst. Meth., B143, 253-271.

Patel, D.C. and Morton, E.J., 1998, "Analysis of improved adiabatic pseudo-domino domino logic family" , Electron. Lett., 34(19), 1829-1830.

Kundu, A and Morton, E.J., 1999, "Numerical simulation of argon-methane gas filled proportional counters" , Nucl. Inst. Meth., A422, 286-290.

Luggar, R.D., Key, M.J., Morton, E.J. and Gilboy, W.B., 1999, "Energy dispersive X-ray scatter for measurement of oil/water ratios ", Nucl. Inst. Meth., A422, 938-941.

Morton, E.J., Crockett, G.M., Sellin, P.J. and DeAntonis, P., 1999, "The charged particle response of CdZnTe radiation detectors", Nucl. Inst. Meth., A422, 169-172.

Morton, E.J., Clark, R.J. and Crowley, C., 1999, "Factors affecting the spectral resolution of scintillation detectors", Nucl. Inst. Meth., A422, 155-158.

Morton, E.J., Caunt, J.C., Schoop, K., Swinhoe, M., 1996, "A new handheld nuclear material analyser for safeguards purposes" , Presentation at INMM annual meeting, Naples, Florida, Jul. 1996.

Hepworth, S., McJury, M., Oldham, M., Morton, E.J. and Doran, S.J., 1999, "Dose mapping of inhomogeneities positioned in radiosensitive polymer gels", Nucl. Inst. Meth., A422, 756-760.

Morton, E.J., Luggar, R.D., Key, M.J., Kundu, A., Tavora, L.M.N. and Gilboy, W.B., 1999, "Development of a high speed X-ray tomography system for multiphase flow imaging", IEEE Trans. Nucl. Sci., 46 III(1), 380-384.

Tavora, L.M.N., Morton, E.J., Santos, F.P. and Dias, T.H.V.T., 2000, "Simulation of X-ray tubes for imaging applications" , IEEE Trans. Nucl. Sci., 47, 1493-1497.

Távora, L.M.N., Morton, E.J. and Gilboy, W.B., 2000, "Design considerations for transmission X-ray tubes operated at diagnostic energies" , J. Phys. D: Applied Physics, 33(19), 2497-2507.

Morton, E.J., Hossain, M.A., DeAntonis, P. and Ede, A.M.D., 2001, "Investigation of Au—CdZnTe contacts using photovoltaic measurements" , Nucl. Inst. Meth., A458, 558-562.

Ede, A.M.D., Morton, E.J. and DeAntonis, P., 2001, "Thin-film CdTe for imaging detector applications", Nucl. Inst. Meth., A458, 7-11.

Távora, L.M.N., Morton, E.J. and Gilboy, W.B., 2001, "Enhancing the ratio of fluorescence to bremsstrahlung radiation in X-ray tube spectra" , App. Rad. and Isotopes, 54(1), 59-72.

Menezes, T. and Morton, E.J., 2001, "A preamplifier with digital output for semiconductor detectors", Nucl. Inst. Meth. A., A459, 303-318.

Johnson, D.R., Kyriou, J., Morton, E.J., Clifton, A.C. Fitzgerald, M. and MacSweeney, J.E., 2001, "Radiation protection in interventional radiology" , Clin. Rad., 56(2), 99-106.

Tavora, L.M.N., Gilboy, W.B. and Morton, E.J., 2001, "Monte Carlo studies of a novel X-ray tube anode design" , Rad. Phys. and Chem., 61, 527-529.

"Morton, E.J., "1998, Is film dead: the flat plate revolution" , Keynote Talk, IPEM Annual Conference, Brighton, Sep. 14-17, 1998"\.

Luggar, R.D., Morton, E.J., Jenneson, P.M. and Key, M.J., 2001, "X-ray tomographic imaging in industrial process control" , Rad. Phys. Chem., 61, 785-787.

Luggar, R.D., Morton, E.J., Key, M.J., Jenneson, P.M. and Gilboy, W.B., 1999, "An electronically gated multi-emitter X-ray source for high speed tomography" , Presentation at SPIE Annual Meeting, Denver, Jul. 19-23, 1999.

Gregory, P.J., Hutchinson, D.J., Read, D.B., Jenneson, P.M., Gilboy, W.B. and Morton, E.J., 2001, "Non-invasive imaging of roots with high resolution X-ray microtomography" , Plant and Soil, 255(1), 351-359.

Kundu, A., Morton, E.J., Key, M.J. and Luggar, R.D., 1999, "Monte Carlo simulations of microgap gas-filled proportional counters" , Presentation at SPIE Annual Meeting, Denver, Jul. 19-23, 1999.

Hossain, M.A., Morton, E.J., and Ozsan, M.E., 2002, "Photo-electronic investigation of CdZnTe spectral detectors" , IEEE Trans. Nucl. Sci, 49(4), 1960-1964.

Panman, A., Morton, E.J., Kundu, A and Sellin, P.J., 1999, "Optical Monte Carlo transport in scintillators" , Presentation at SPIE Annual Meeting, Denver, Jul. 19-23, 1999.

Jenneson, P.M., Gilboy, W.B., Morton, E.J., and Gregory, P.J., 2003, "An X-ray micro-tomography system optimised for low dose study of living organisms" , App. Rad. Isotopes, 58, 177-181.

Key, M.J., Morton, E.J., Luggar, R.D. and Kundu, A., 2003, "Gas microstrip detectors for X-ray tomographic flow imaging" , Nucl. Inst. Meth., A496, 504-508.

Jenneson, P.M., Luggar, R.D., Morton, E.J., Gundogdu, O, and Tuzun, U, 2004, "Examining nanoparticle assemblies using high spatial resolution X-ray microtomography" , J. App. Phys, 96(5), 2889-2894.

(56) References Cited

OTHER PUBLICATIONS

Tavora, L.M., Gilboy, W.B. and Morton, E.J., 2000, "Influence of backscattered electrons on X-ray tube output", Presentation at SPIE Annual Meeting, San Diego, Jul. 30-Aug. 3, 2000.

Wadeson, N., Morton, E.J., and Lionheart, W.B., 2010, "Scatter in an uncollimated x-ray CT machine based on a Geant4 Monte Carlo simulation" , SPIE Medical Imaging 2010: Physics of Medical Imaging, Feb. 15-18, 2010, San Diego, USA.

Morton, E.J., 2010, "Position sensitive detectors in security: Users perspective" , Invited talk, STFC meeting on position sensitive detectors, RAL, May 2010.

* cited by examiner

X-RAY TUBE ELECTRON SOURCES

CROSS-REFERENCE TO RELATED APPLICATIONS

The present application is a national stage application of PCT Application Number PCT/GB2010/050125, which was filed on Jan. 27, 2010, and relies on Great Britain Patent Application No. 0901338.4 filed on Jan. 28, 2009.

FIELD OF THE INVENTION

The present invention relates to X-ray tubes, to electron sources for X-ray tubes, and to X-ray imaging systems.

BACKGROUND OF THE INVENTION

X-ray tubes include an electron source, which can be a thermionic emitter or a cold cathode source, some form of extraction device, such as a grid, which is arranged to control the extraction of electrons from the emitter, and an anode which produces the X-rays when impacted by the electrons. Examples of such systems are disclosed in U.S. Pat. No. 4,274,005 and U.S. Pat. No. 5,259,014.

With the increasing use of X-ray scanners, for example for medical and security purposes, it is becoming increasingly desirable to produce X-ray tubes which are relatively inexpensive and which have a long lifetime.

SUMMARY OF THE INVENTION

Accordingly the present invention provides an electron source for an X-ray scanner comprising an emitter support block. An electron-emitting region may be formed on the support block and arranged to emit electrons. An electrical connector may be arranged to connect a source of electric current to the electron-emitting region. Heating means may be arranged to heat the support block.

The present invention further provides a control system for an X-ray scanner. The system may comprise an input arranged to receive an input signal identifying which of a plurality of electron emitters is to be active. The system may be arranged to produce a plurality of outputs each arranged to control operation of one of the emitters. In some embodiments each of the outputs can be in a first state arranged to activate its respective emitter, a second state arranged to de-activate said emitter, or a third state arranged to put said emitter into a floating state.

The present invention further provides a control system for an X-ray scanner, the system comprising an input arranged to receive an input signal identifying which of a plurality of electron emitters is to be active, and to produce a plurality of outputs each arranged to control operation of one of the emitters. The system may further comprise output monitoring means arranged to monitor each of the outputs, and the monitoring means may be arranged to generate a feedback signal indicating if any of the outputs exceeds a predetermined threshold.

The present invention further provides a control system for an X-ray scanner, the system comprising an input arranged to receive an input signal identifying which of a plurality of electron emitters is to be active, and to produce a plurality of outputs each arranged to control operation of one of the emitters, wherein each of the outputs can be in a first state arranged to activate its respective emitter, and a second state arranged to de-activate said emitter. The system may further comprise blanking means arranged to fix all of the outputs in the second state irrespective of which state the input signal indicates they should nominally be in.

BRIEF DESCRIPTION OF THE DRAWINGS

Preferred embodiments of the present invention will now be described by way of example only with reference to the accompanying drawings in which.

DETAILED DESCRIPTION

Figure 1:
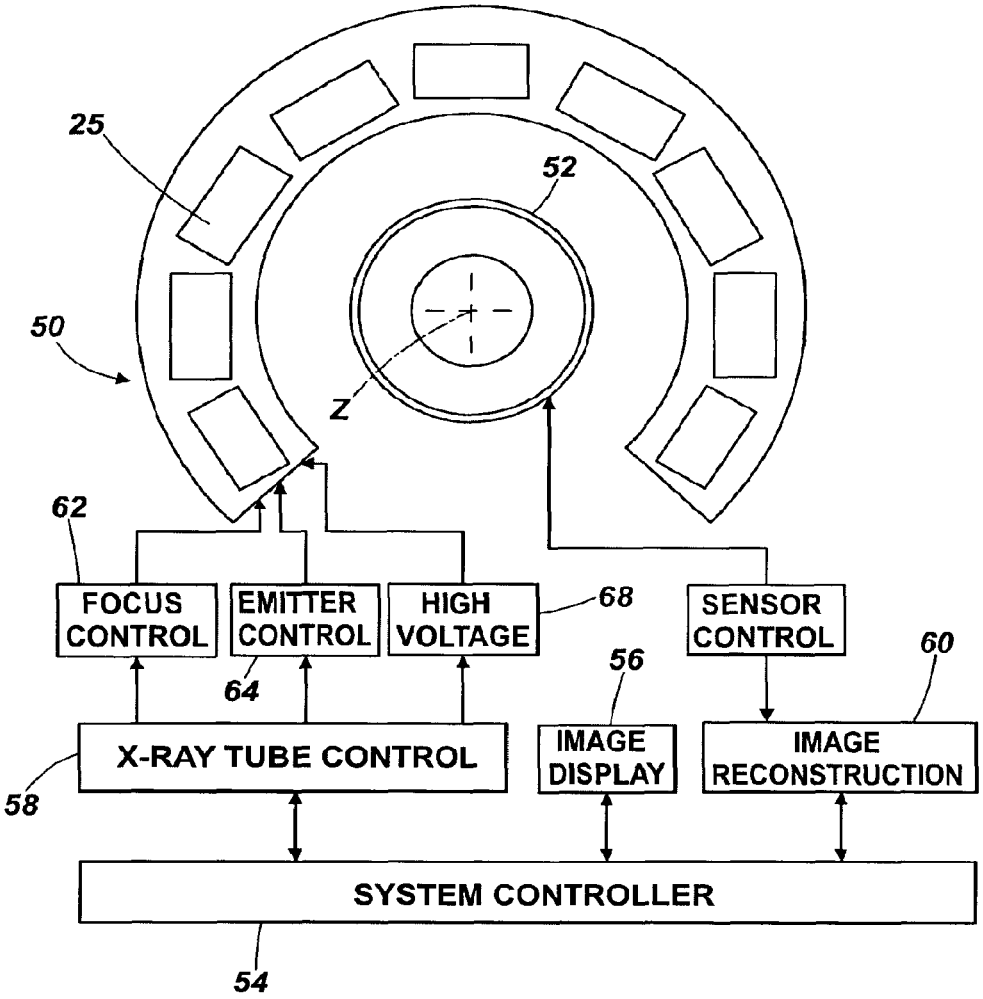
FIG. 1 is schematic view of an X-ray scanner according to an embodiment of the invention.

Referring to FIG. 1, an X-ray scanner 50 comprises an array of X-ray emitter units 25 arranged in an arc around a central scanner Z axis, and orientated so as to emit X-rays towards the scanner Z axis. A ring of sensors 52 is placed inside the emitters, directed inwards towards the scanner Z axis. The sensors 52 and emitter units 25 are offset from each other along the Z axis so that X-rays emitted from the emitter units pass by the sensors nearest to them, through the Z axis, and are detected by the sensors furthest from them.

Figure 2A:
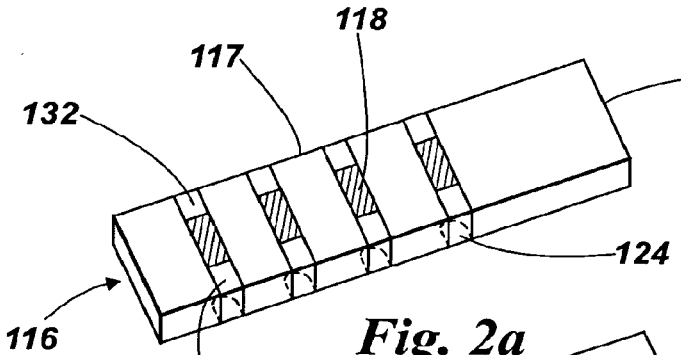
FIG. 2*a* is top perspective view of an emitter element of the scanner of FIG. 1.
Figure 2B:
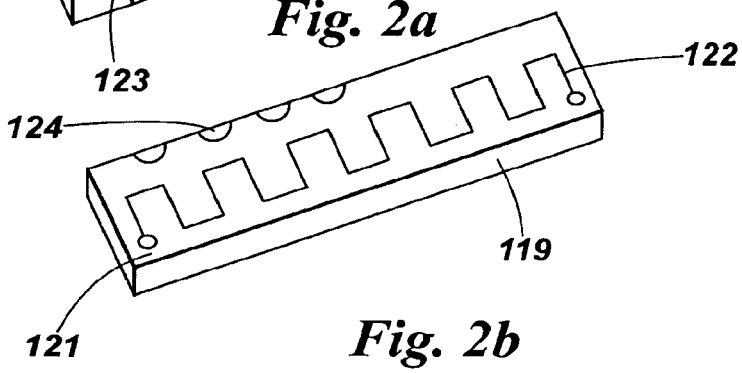
FIG. 2*b* is a bottom perspective view of the emitter element of FIG. 2*a;*

Referring to FIGS. 2*a* and 2*b* each of the emitter units 25 includes an electron emitter element 116 which comprises an aluminium nitride (AlN) emitter support block 117 with low work function emitters 118 on its top surface 120 and platinum (Pt) heater element 122, on its bottom surface 121. The emitters 118 are formed from platinum-based ink coated with a highly emitting coating, and the heater element is also formed from Pt-based ink. The emitters cover discrete spaced apart areas on the surface 120 of the block 117, spaced along its length, and a connecting strip 123 of electrically conducting material extends from each of the emitters 118 around the side of the block 117 to its under side 121, where they form connector pads 124. The connecting strips are also spaced apart from each other, so that each emitter 118 is electrically isolated from the other emitters 118. Aluminium nitride (AlN) is a high thermal conductivity, strong, ceramic material and the thermal expansion coefficient of AlN is closely matched to that of platinum (Pt). Alumina ($Al_2O_3$) can also be used for the substrate as it has similar properties. These properties lead to the design of an integrated heater-electron emitter element suitable for use in X-ray tube applications.

AlN is a wide bandgap semiconductor material and a semiconductor injecting contact is formed between Pt and AlN. To reduce injected current that can occur at high operating temperatures, it is advantageous to replace the injecting contact with a blocking contact. This may be achieved, for example, by growing an aluminium oxide layer on the surface of the AlN substrate 120 prior to fabrication of the Pt metallisation. The provision of an oxide layer between the AlN and the Pt emitter forms a suitable blocking contact.

Alternatively, a number of other materials may be used in place of Pt, such as tungsten or nickel. Typically, such metals may be sintered into the ceramic during its firing process to give a robust hybrid device.

In some cases, it is advantageous to coat the metal on the AlN substrate with a second metal such as Ni. This can help to extend lifetime of the oxide emitter or control the resistance of the heater, for example.

To form the heater element 122 of this embodiment the Pt metal is formed into a track of 1-3 mm wide with a thickness of 10-200 microns to give a track resistance at room temperature in the range 5 to 200 ohms. It is advantageous to limit the heater voltage to below 100V to avoid electrical cross talk to the emitter pads 118 on the upper surface 120 of the substrate. By passing an electrical current through the track, the track will start to heat up and this thermal energy is dissipated directly into the AlN substrate. Due to the excellent thermal conductivity of AlN, the heating of the AlN is very uniform across the substrate, typically to within 10 to 20 degrees. Depending on the current flow and the ambient environment, stable substrate temperatures in excess of 1100 C can be achieved. Since both AlN and Pt are resistant to attack by oxygen, such temperatures can be achieved with the substrate in air. However, for X-ray tube applications, the substrate is typically heated in vacuum.

The emitter pads 118, heater element 122, and connecting strips 123, are applied to the surface of the substrate block 117 in the required pattern by printing. The connector pads 124 are formed by applying several layers of ink by means of multiple printing so that they are thicker than the connecting strips 123. The connectors at the ends of the heater element 122 are built up in the same way. The substrate block 117 is then heated to around 1100 C to sinter the ink into the surface of the substrate block 117. The emitter pads 118 are then coated with a Ba:Sr:Ca carbonate material in the form of an emulsion with an organic binder. This coating can be applied using electrophoretic deposition or silk screen printing. When the emitter element 116 is installed, before it is used, the heater element 122 is used to heat the substrate block 117 to over 700 C, which causes the carbonate material firstly to eject the organic binder material, and then to convert from the carbonate to the oxide form. This process is known as activation. The most active material remaining in the emitter pad coating is then barium oxide, and electron emission densities in excess of 1 $mA/mm^2$ can be achieved at operating temperatures of around 850-950 C.

Figure 3:
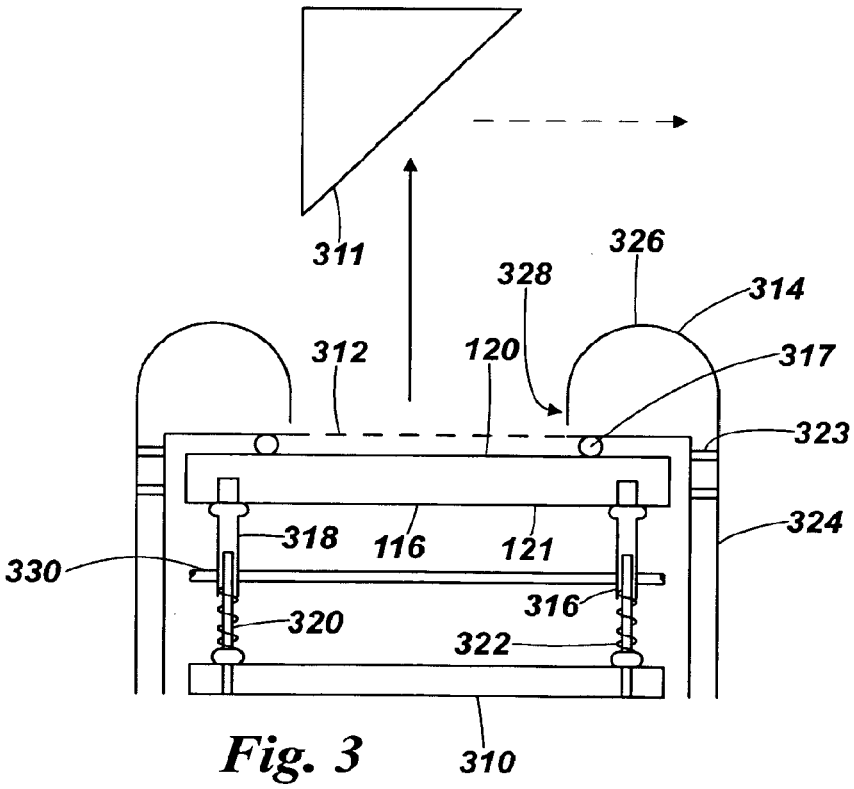
FIG. 3 is a transverse section through an X-ray emitter unit of the system of FIG. 1.

Referring to FIG. 3, each emitter unit 25 comprises an emitter element 116, a circuit board 310 that provides the electrical control of the emitter element 116, a grid 312 arranged to control extraction of electrons from each of the emitter pads 118, and focusing elements 314 arranged to focus the beam of extracted electrons towards a target area on an anode 311. Typically, the underlying circuit board 310 will provide vacuum feedthrus for the control/power signals that are individually controlled on an emitter-by-emitter basis. The circuit board is best made of a material with low outgassing properties such as alumina ceramic.

The emitter element 116 is connected to the circuit board 310 by means of sprung connection elements 316. These provide physical support of the emitter element over the circuit board 310, and also each connection element 316 provides electrical connection between a respective one of the connector pads 124 on the emitter element 116 and a respective connector on the circuit board 310. Each connection element 316 comprises an upper tube 318 connected at its upper end to the emitter element so that it is in electrical contact with one of the connector pads 124, and a lower tube 320 of smaller diameter, mounted on the circuit board 310 with its lower end in electrical contact with the relevant contact on the circuit board 310. The upper end of the lower tube 320 is slidingly received within the lower end of the upper tube 318, and a coil spring 322 acts between the two tubes to locate them resiliently relative to each other, and therefore to locate the emitter element 116 resiliently relative to the circuit board 310.

The connector elements 316 provide electrical connection to the connector pads 124, and hence to the emitter pads 118, and mechanical connection to, and support of, the AlN substrate. Preferably the springs 322 will be made of tungsten although molybdenum or other materials may be used. These springs 322 flex according to the thermal expansion of the electron emitter assembly 116, providing a reliable interconnect method. The grid 312 and focussing elements 324 are less affected by thermal expansion and therefore provide a fixed location. The top of the emitter element 116 is kept at a fixed distance from the grid 312 by spacers in the form of sapphire spheres 317. Hence the emitter pads 118 are held stationary by being clamped against the grid 312, via the sapphire spacers 317, during any thermal expansion or contraction of the emitter assembly 116. The potential of each of the emitter pads 118 can therefore be switched between an emitting potential, which is lower than that of the grid 312 such that electrons will be extracted from the emitter 118 towards the grid 312, and a blocking, or non-emitting, potential, which is higher than that of the grid, so that electrons will tend not to leave the surface of the emitter 118, or if they do, will be attracted back towards the emitter.

Figure 4:
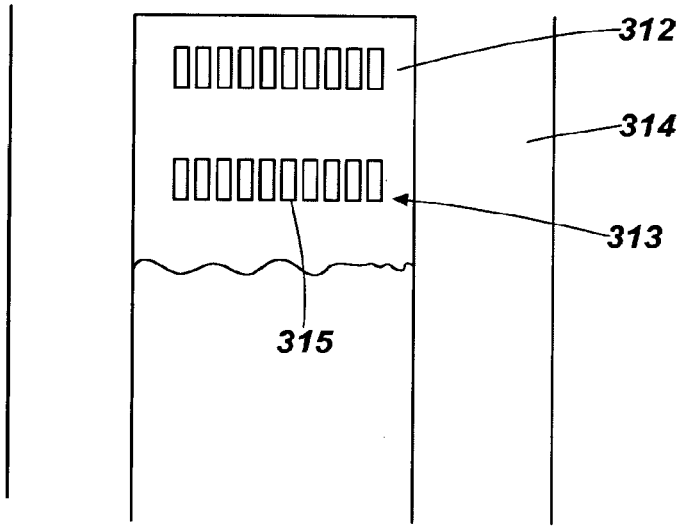
FIG. 4 is a plan view of the emitter of FIG. 3.

Referring also to FIG. 4 the grid 312 is formed from a thin foil of tungsten. It extends over the upper surface 120 of the emitter element 116, and down past the sides of the emitter element 116, through the plane containing the lower surface 121 of the emitter block. It also extends down as far as the circuit board 310, passing through the plane including the front face of the circuit board, and the plane containing the rear face of the circuit board. The grid 312 includes a number of extraction areas 313 each of which extends over a respective one of the emitter pads 118 and has a series of narrow apertures 315 formed in it. The apertures 315 make up at least 50% of the area of the extraction areas. Each extraction area 313 covers an area approximately equal to the area of, and located directly above, the emitter pad 118. The areas of the grid 312 between the extraction areas are solid. The grid 312 therefore helps to focus the extracted electron beams from the individual emitter pads 118. The apertures 315 are formed using chemical etching of the tungsten foil. The grid 312 therefore forms an almost continuous layer over the emitter element 116, apart from the apertures 315. The sapphire spacers 317 maintain a fixed spatial relationship between the top surface 120 of the emitter element and the upper portion of the grid 312, and the side portions of the grid 312 are spaced from the emitter element 116 and the circuit board 310. The grid 312 therefore forms an effective heat shield enclosing the emitter element 116 on both sides and over its top surface. This partial enclosure reduces the radiation of heat from the emitter element. Other materials such as molybdenum can also be used for the grid 312. The grid 312 is connected to an electrical connector on the circuit board 310 so that its electrical potential can be controlled. The grid 312 is supported close to the emitter pads 118, with a gap between them of the order of 1 mm. This enables the extraction voltage (i.e. the difference in voltage between an active emitter pad 118 and the grid) to be kept low, for example below 200V while achieving beam currents in excess of 1 mA/mm$^2$.

The focusing elements 314 extend one along each side of the emitter element 116. Each focusing element 314 is mounted on isolating mountings 323 so as to be electrically isolated from the grid 312 and the emitter element 116. It includes a flat lower portion 324 that extends parallel to, and spaced from, the side portions of the grid 312, and a curved portion 326 that extends upwards from the lower portion 324 beyond the grid upper portion, over in a curved cross section, and back towards the grid 312, with its inner edge 328 extending along the length of the emitter, spaced from the grid 312 and approximately level, in the lateral direction, with the edge of the emitter pads 118. This leaves a gap between the two focusing elements 314 that is approximately equal in width to the emitter pads 118 and the apertured areas of the grid 312. The focusing elements 314 are both held at an electric potential that is negative with respect to the grid 312, and this causes an electric field that focuses in the lateral direction the electrons extracted from the emitters. The focusing elements form a further, outer heat shield, spaced from the grid 312, which further reduces the radiation of heat away from the emitter elements 116.

Referring to FIG. 3, a heat shield or reflector 330 is located between the emitter element 116 and the circuit board 310. In this embodiment, the heat shield 330 is formed from a mica sheet coated in a thin layer of gold. The addition of a titanium layer between the gold and the mica improves adhesion of the gold. The heat reflector 330 is supported on the sprung connection elements 316, which extend through holes in the reflector 330. Its coated upper surface is located close to, but spaced from, and facing, the lower heated side 121 of the AlN substrate. This reflects heat from the emitter element back towards it, and thereby improves the heater efficiency, reducing the loss of heat through radiative heat transfer. With the grid 312 enclosing the top and sides of the emitter element, and the shield 330 enclosing its under-side, the emitter element is surrounded on all four sides by heat shielding. Heat shielding can also be provided at the ends of the emitter element 116, but this is less important as the emitter elements are placed end-to-end in close proximity to each other. Silica can be used as an alternative substrate for the reflector, and other reflective materials such as Ti or multi-layer IR mirrors can also be used. Further similar reflectors can also be provided between the emitter element 116 and the grid 312.

Referring back to FIG. 1, the scanner is controlled by a control system which performs a number of functions represented by functional blocks in FIG. 1. A system control block 54 controls, and receives data from, an image display unit 56, an X-ray tube control block 58 and an image reconstruction block 60. The X-ray tube control block 58 controls a focus control block 62 which controls the potentials of the focus elements 314 in each of the emitter units 25, an emitter control block 64 which controls the potential of the individual emitter pads 118 in each emitter unit 25, and a high voltage supply 68 which provides the power to the anode 311 of each of the emitter blocks and the power to the emitter elements 118. The image reconstruction block 60 controls and receives data from a sensor control block 70 which in turn controls and receives data from the sensors 52.

Figure 5:
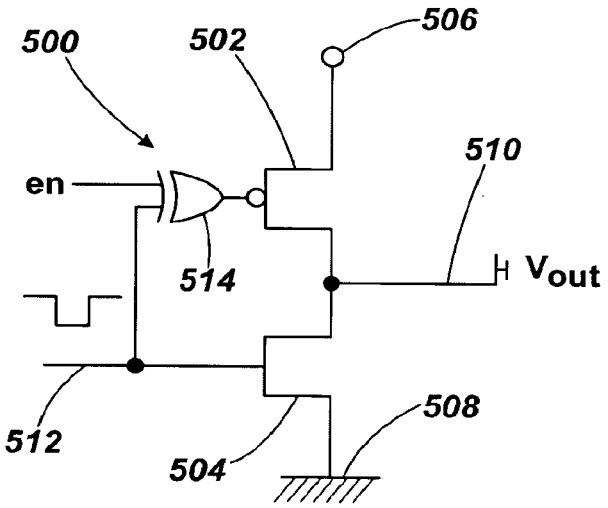
FIG. 5 is a diagram of an output stage forming part of a control device of the emitter unit of FIG. 3.

Referring to FIG. 5, the circuit board 310 includes a high voltage push-pull output stage 500 for each of the emitter pads 118, arranged to provide a high voltage signal to it to control the emission of electrons from it. Each output stage 500 comprises a pair of transistors, in this case FETs, 502, 504 connected in series between the supply 506 and ground 508. The HV output 510 is connected between the two FETs. A drive input 512 is connected directly to the second FET 504 and via an XOR gate 514 and an inverter to the first FET 502. The XOR gate 514 has a second input en (the drive input being the first). This input en is usually low, so that the output of the XOR gate 514 matches the input, but can be used to provide further control as will be described further below with reference to FIG. 6. When the input signal goes low, the first FET 502 is switched on and connects the output 510 to the supply voltage and the second FET 504 is switched off and isolates the output from ground. The output voltage therefore rises quickly to the supply voltage. When the input goes low, the first FET is switched off and isolates the output 510 from the supply voltage and the second FET 504 is switched on and connects it to ground, so that the output voltage falls rapidly to zero. Therefore this output stage 500 allows the emitter to be switched on and off rapidly in a well controlled manner, so that the position of the source of the X-ray beam can be accurately controlled. If the input is at an intermediate level that is not high enough to turn on the second FET 504 or low enough to turn on the first FET 502, then both of the FETs are turned off and the output is in a floating tri-state condition, in which it is disconnected from the fixed potentials of the HV supply and ground and is free to fluctuate. This puts the emitter pad 118 into an electrically isolated state which inhibits electron extraction from the emitter pad 118.

Figure 6:
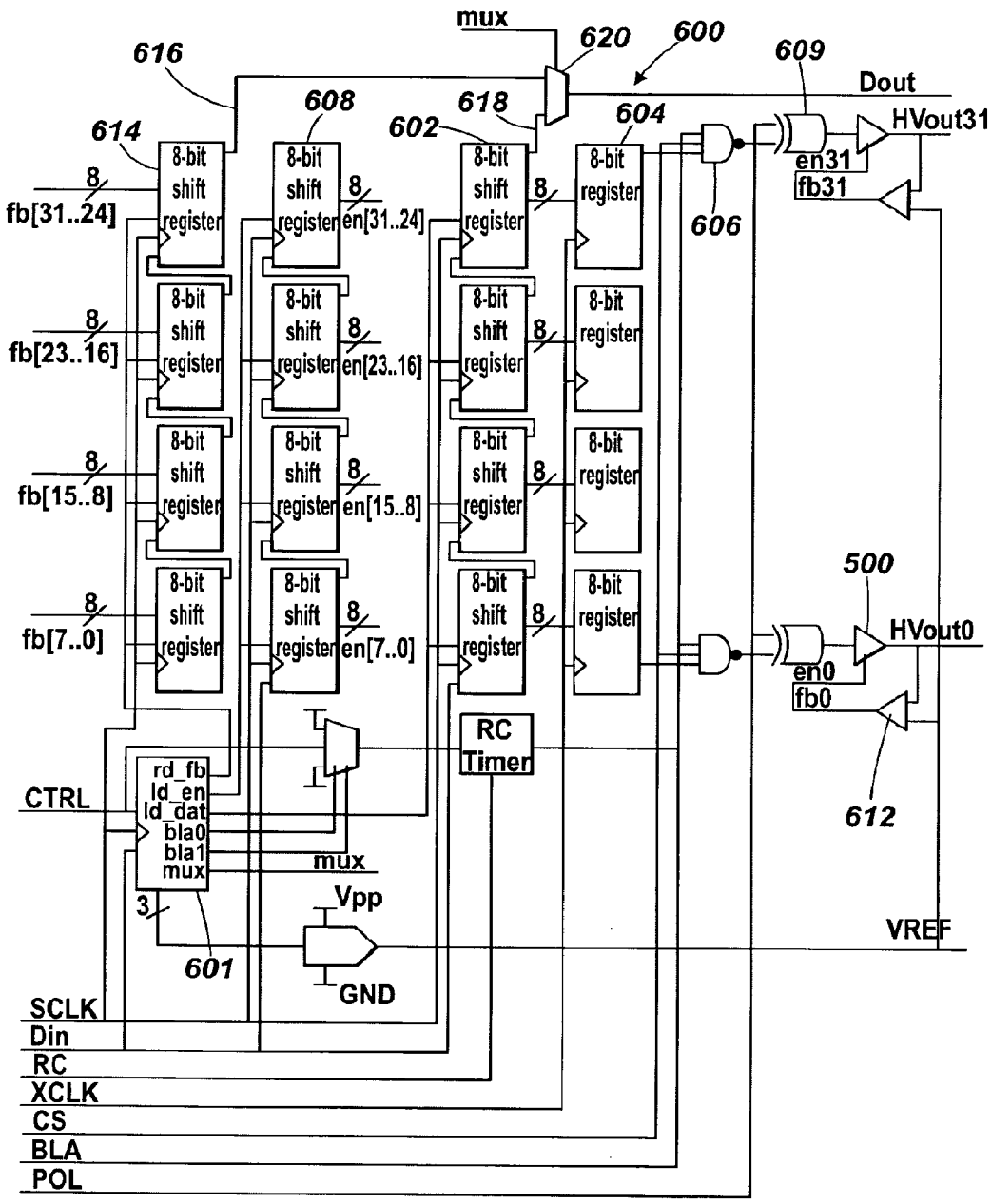
FIG. 6 is a circuit diagram of a control device of the emitter of FIG. 3.

Referring to FIG. 6, the emitter control block 64 of the control system provides a digital emitter control signal which is input to a number of emitter control devices 600, each of which is arranged to control the operation of 32 electron emitter pads in one of the X-ray emitter units 25. Each control device 600 receives as an input signal a serial digital signal Din which includes data indicating which of the emitters should be turned on and which turned off, and which should be in the floating state. This input signal is fed to a processor 601, and a number of shift registers 602, 604, 608, 614 which control and monitor the output of the output stages 500, of which there is one for each of the 32 controlled emitters.

The processor 601 is arranged to receive a control signal CTRL as well as the data signal Din and a clock signal SCLK, and to output a number of signals that control operation of the shift registers, and other functions of the device 600.

One of the registers is a data register 602, in the form of 32 bit serial-in-parallel-out (SIPO) shift register, and is arranged to receive the serial input signal Din, which includes data indicating the required state of each of the emitters 118 for a particular cycle, to load that data under control of a signal ld_dat from the processor 601 and a clock signal SCLK. It is arranged to output the 32 required states to the inputs of a parallel-in-parallel-out data register 604, which loads them under control of a clock signal XCLK. The data register 604 presents the loaded data at its parallel outputs to one of three inputs to respective NAND gates 606. Assuming for now that the other inputs to the NAND gates 606 are all high, the outputs of each NAND gate 606 will be low if its respective emitter 118 is to be active, and high if it is to be inactive. The output from each NAND gate 606 is fed to one input of an exclusive-OR (EOR) gate 609, the other input of which is arranged to receive a polarity signal POL. The output of each EOR gate 609 is input to a respective output stage 500, each of which is as shown in FIG. 5, which therefore provides the controlled HV output HVout to the emitter. The polarity signal POL allows the polarity of the system to be reversed. For example when the grid is fixed at –HV (or ground) potential then a positive voltage is needed on the emitter to turn the beam off. If, however, the emitter potential at −HV (or ground) then a negative potential is needed to turn the beam off. The XOR gate and POL input allows the circuit to be used in either configuration.

A tri-state register 608, in the form of a second 32 bit SIPO register, is arranged to receive the serial input signal Din which also includes data indicating which of the outputs should be set to the tri-state (or floating state) condition. This data is read from the input signal and loaded into the tri-state register 608 under the control of the signal ld_en and the clock signal SCLK. This data is then output in parallel to the respective output stages 500, with the output en being high if the output stage 500 is to be switched to the tri-state condition, and low if the output stage is to be set to the high or low level as determined by the output from the respective NAND gate 606. Referring back to FIG. 3, when the enable signal en is high, the emitter will be in the floating condition when the input signal to the output stage is low. Data from the serial input signal Din can therefore be used to set any one or more of the emitters 118 to the tri-state condition. This is useful, for example, during initial activation of the emitters 118, when all of the emitters are set to the tri-state condition, or if short circuits occurred affecting one or more emitters, for example connecting it to the grid, in which case setting the affected emitters to the floating state would allow the short circuit to be mitigated.

Each NAND gate 606 also has one input connected to a blanking signal BLA. Therefore if the blanking signal BLA is high, the output of the NAND gate 606 will be low regardless of the output from the data register 602. The blanking signal can therefore be used to set the outputs of any of the NAND gates to a blanked state, in which they are constant or at least independent of the input data, or an active state, in which they are controlled by the input data. A further chip select input CS is provided to all of the NAND gates and can be used to activate or de-activate the whole control chip 600.

Each HV output HVout is input to a respective comparator 612 which is arranged to compare it to a threshold signal VREF, and produce a feedback output indicative of whether the output drive signal is above or below the threshold. This feedback data, for all 32 output signals, is input to a parallel-in-serial-out feedback register 614, under control of a signal rd_fb from the processor 601, and the feedback register 614 converts it to a serial feedback output 616. This output 616 therefore indicates if any of the outputs is supplying excessive current, which can be used as an indication of, for example, a short circuit problem. The level of the reference signal VREF is set by the processor 601.

A serial output 618 is also provided from the data register 602 which is indicative of whether each of the output signals is nominally at the high or low level. These two serial outputs are multiplexed by a multiplexer 620, under the control of a multiplexing control signal mux from the processor 601, to produce a single serial digital output signal Dout. This allows the expected output values to be checked from 618, for example to check the programming of the device, and the actual values to be checked from 616 to check that the correct outputs have actually been achieved.

Figure 7:
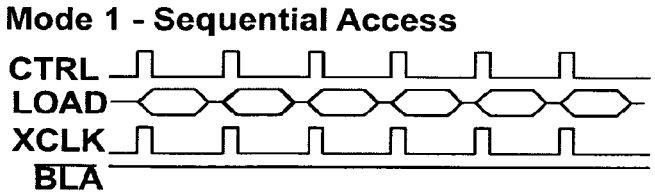
FIGS. 7, 8 and 9 are timing diagrams showing operation of the control device of FIG. 6 in three different operating modes.
Figure 8:
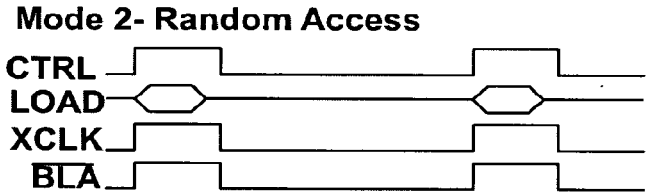

The control device 600 is arranged to operate in three different modes: a sequential access mode, a random access mode, and a non-scanning or reset mode. In the sequential access mode, the X-ray beam is scanned around the X-ray sources sequentially. Therefore in each full scan of all emitters, each control device will be active for a single period within the scan, and during that period, will activate each of the emitters it controls in sequence for respective activation periods. In the random access mode, the X-ray source is moved around the X-ray source array in a pseudo-random manner. Therefore, in each scan of all emitters, each control device will activate one of its emitters for one activation period, and then will be inactive for a number of activation periods while emitters controlled by other devices 600 are active, and will then be active again for a further activation period when another of its emitters is active. Some of the control inputs for the sequential access mode are shown in FIG. 7, and for the random access mode in FIG. 8. The signal marked 'LOAD' is not a specific signal, but is indicative of the times at which the device 600 is actively providing power to one of the emitters. As can be seen, in the sequential access mode, the blanking signal BLA is held high for a period covering successive activation periods while the emitters are activated in turn. Therefore the outputs track the data loaded in the data register 604. In the random access mode, the blanking signal is high only during the activation periods in which one of the emitters controlled by the device 600 is active. Therefore, for those activation periods, the outputs track the data in the data register 604. For intervening activation periods, the blanking signal is low, so the outputs are all turned off. This ensures that whatever processing is being carried out by the device 600 during those intervening periods does not affect the device's outputs and therefore does not affect the control of the emitters. This mode is suitable for scanning methods such as the random-access method described above, in which the emitter unit is active, in the sense of emitting electrons and hence X-rays, for a number of activation periods during a scan, but inactive for a number of intervening periods during which other emitter units are active.

Figure 9:
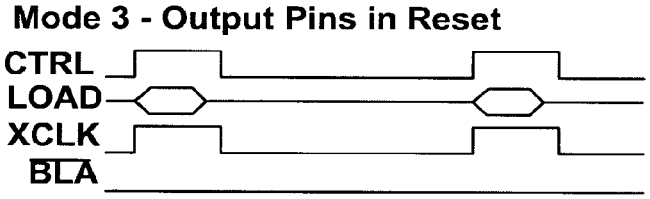

Referring to FIG. 9, in the non-scanning mode, which is the default mode, the blanking signal is kept low, so the outputs are all maintained in the off condition and all of the emitters are inactive. This mode is used, for example, to enable calibration of the data acquisition system.

The format of the data input signal Din is a 5-byte programming pattern having the following format:

| | |
|---|---|
| MSB | Control word |
| | Status/data word 0 (MSB) |
| | Status/data word 1 |
| | Status/data word 2 |
| LSB | Status/data word 3 (LSB) |

The control word has a bit configuration such as:

| | | | |
|---|---|---|---|
| MSB | 7 | 1 = load data register | 0 = no action |
| | 6 | 1 = read status register | 0 = read data register |
| | 5 | 1 = set tri-state register | 0 = no action |
| | 4 | 1 = set BLA hi (Mode 1) | 0 = normal action (Mode 2) |
| | 3 | 1 = set BLA lo (Mode 3) | 0 = normal action (Mode 2) |
| | 2 | Don't care | |
| | 1 | Don't care | |
| LSB | 0 | Don't care | |

Therefore one 5-byte input signal is required for each emitter activation period, and the signal indicates by means of the four data/status bytes which emitter is to be active, and by means of the control byte which mode the system is in. The emitter control block 64 sends a serial data input signal to a control device 600 for each of the emitter units 25 of the scanner so as to coordinate operation of all of the emitters in the scanner.

In this embodiment as shown in FIG. 6, the threshold voltage is generated by an on-chip DAC programmed using the lower 3 bits of the control word. The same threshold programming voltage is applied to all 32 output channels. In this case, the control word is assigned the following bit pattern:

| | | | |
|---|---|---|---|
| MSB | 7 | 1 = load data register | 0 = no action |
| | 6 | 1 = read status register | 0 = read data register |
| | 5 | 1 = set tri-state register | 0 = no action |
| | 4 | 1 = set BLA hi (Mode 1) | 0 = normal action (Mode 2) |
| | 3 | 1 = set BLA lo (Mode 3) | 0 = normal action (Mode 2) |
| | 2 | 1 = set threshold voltage | 0 = no action |
| | 1 | Threshold voltage DAC bit 1 (MSB) | |
| LSB | 0 | Threshold voltage DAC bit 0 (LSB) | |

In operation, an object to be scanned is passed along the Z axis, and the X-ray beam is generated by controlling the emitter pad potentials so that electrons from each of the emitter pads 118 in turn are directed at respective target positions on the anode 311 in turn, and the X-rays passing through the object from each X-ray source position in each unit detected by the sensors 52. As described above, for some applications the beam is arranged to scan along the emitter in discrete steps, and for some it is arranged to switch between the emitter pads 118 in a pseudo-random manner to spread the thermal load on the emitter. Data from the sensors 52 for each X-ray source point in the scan is recorded as a respective data set. The data set from each scan of the X-ray source position can be analysed to produce an image of a plane through the object. The beam is scanned repeatedly as the object passes along the Z axis so as to build up a three dimensional tomographic image of the entire object.

In an alternative embodiment the connector elements 316 of FIG. 3 are inverted. However, the advantage of the spring 322 being near to the circuit board and further from the emitter element 118 is that the upper tube 318 runs at high temperature and the spring 322 at low temperature. This affords a greater choice of spring materials since creeping of the spring is lower at lower temperatures.

As an alternative to the wraparound interconnects 124 of the embodiment of FIGS. 2*a* and 2*b*, through-hole Pt interconnects can be used which extend through holes in the AlN substrate 120 to connect the emitter pads 118 to connectors on the underside of the emitter element 116. In a further modification, a clip arrangement may be used to connect the electrical power source to the top surface of the AlN substrate.

It will be appreciated that alternative assembly methods can be used including welded assemblies, high temperature soldered assemblies and other mechanical connections such as press-studs and loop springs.

Figure 10:
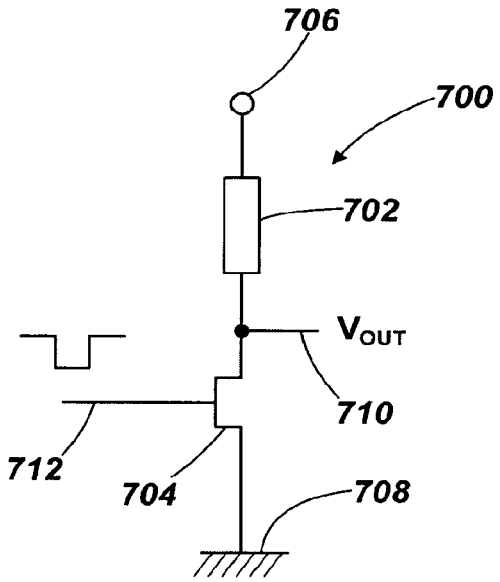
FIG. 10 is a diagram of an output stage forming part of a further embodiment of the invention.

Referring to FIG. 10, in a further embodiment, the output stages of FIG. 5 are each replaced by an alternative output stage 700. In this embodiment, the output 710 is connected to the supply 706 via a resistance 702, and to ground 708 via an FET 704 which is switched on and off by the input signal on the input 712. (The XOR gate is omitted from the drawing for simplicity). While the input signal is high, the FET 704 is switched on and the output 710 is connected to ground. When the input signal goes low, the FET 704 is switched off, and the output is connected via the resistor 702 to the supply 706, switching the source on slowly. When the input signal goes high again, the FET 704 again connects the output 710 to ground, switching the source off more rapidly.

Figure 11A:
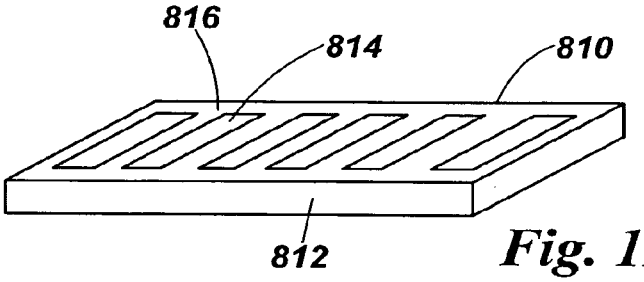
FIGS. 11*a* and 11*b* are top and bottom perspective views of an emitter element according to a further embodiment of the invention.
Figure 11B:
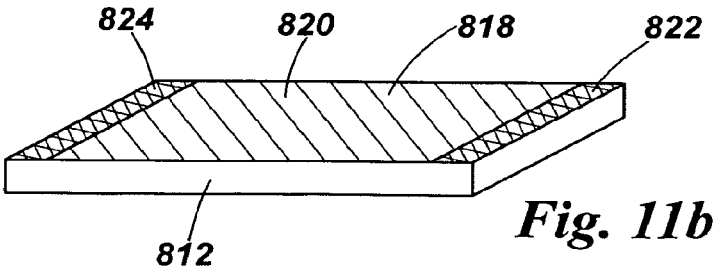

Referring to FIGS. 11*a* and 11*b*, in a further embodiment each emitter element 810 is formed from a ceramic substrate 812, in this case alumina ($Al_2O_3$) although AlN can again also be used, with individual spaced apart metal emitter pads 814 formed on its upper surface 816 by sputter coating. The emitter pads can be formed of any suitable metal, such as Ni, Pt or W, and they are covered with an active oxide layer to enhance electron emission as in the embodiment of FIGS. 2*a* and 2*b*. Patterning of the individual emitter pads 814 is achieved using shadow masks during sputter coating, although photolithographic methods can also be used.

On the opposite side 818 of the substrate from the emitter pads, a heating element in the form of a continuous conductive film 820 is applied, which in this case covers the whole of the rear side 818 of the emitter element 810. The heating element is also formed by means of sputter coating, and at each end of the emitter element, the conductive film is made thicker, by further sputter coating, to form contact areas 822, 824. Clearly since the substrate is electrically non-conducting, the heating element 820 is electrically isolated from the emitter pads, which in turn are electrically isolated from each other.

Figure 12:
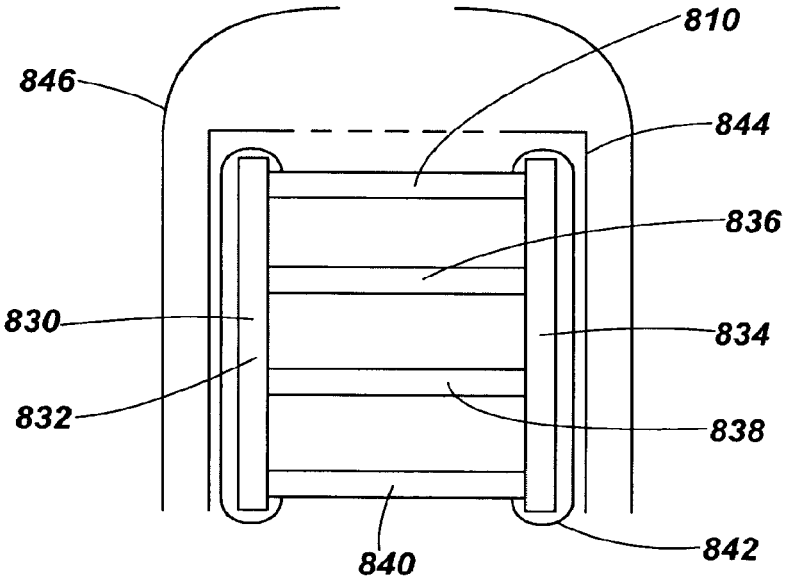
FIG. 12 is a transverse section through an electron source unit including the emitter element of FIGS. 11*a* and 11*b*.

Referring to FIG. 12, each emitter element 810 is supported in a supporting heat shield structure 830, which is formed from two side elements 832, 834 and two cross members 836, 838 which extend between the side elements 832, 834 and hold them parallel to, and spaced apart from, each other. The emitter element 810 is supported between the upper (as shown in FIG. 9) edges of the side elements, parallel to the cross members 836, 838, with the emitter pads 814 facing outwards, i.e. upwards as shown, and a circuit card 840 is supported between the lower edges of the side elements 832, 834.

The side elements 832, 834 and the cross members 836, 838 are formed from silica plates, which are formed into interlocking shapes by laser cutting. These plates therefore interlock to form a stable mechanical structure. The silica material is coated on one side, the side facing the emitter element 810, with a high reflectance low emissivity material, such as Au or Ti. Alternatively the silica may be coated with a multi-layer infra-red mirror.

A series of connecting wires 842 each have one end connected to a respective one of the emitter pads 814, and extend around the outside of the heat shield structure 830, having their other ends connected to respective connectors on the circuit card 840. The interconnecting circuit card 840 is used to transfer signals from outside the vacuum envelope of the scanner, either directly through a hermetic seal or indirectly through a metal contact which engages with a hermetic electrical feedthru.

A grid 844, similar to that of FIG. 3, extends over the top of the emitter element 810 and down the sides of the heat shield structure 830, being spaced from the side elements 832, 834 to leave an insulating gap, through which the connecting wires 842 extend. The top part of the grid 844 is parallel to the upper surface 816 of the emitter element and spaced from it by a small distance of, in this case, about 1 mm. Focusing elements 846 are arranged on either side of the heat shield 830 and emitter 810. Each one extends along parallel to the side elements 832, 834, outside the grid 844 and spaced from it by a further insulating gap, and up over the side of the emitter element 810. Each focusing element has its upper edge extending part way over the emitter element 810, so that a focusing gap is left, between the focusing elements 846, which extends along the emitter over the emitter pads 814.

As with the embodiment of FIG. 3, the grid 844 and focusing elements 846 are connected to appropriate electrical potentials and serve, as well as their primary functions, as additional heat shields to reduce the radiation of heat away from the emitter element 810.

We claim:

1. A control system for an X-ray scanner, the system comprising:

an input arranged to receive an input signal identifying which of a plurality of electron emitters is to be active and to produce a plurality of outputs, wherein each of the plurality of outputs is arranged to control an operation of one of the plurality of electron emitters, wherein each of the plurality of outputs is configured to be in a first state arranged to activate said one of the plurality of electron emitters, a second state arranged to de-activate said one of the plurality of electron emitters, or a third state arranged to put said one of the plurality of electron emitters into a floating state;

an output stage associated with each of the plurality of electron emitters, wherein each output stage is arranged to generate a high voltage output, wherein each output stage is arranged to connect said one of the plurality of electron emitters to a first voltage supply connection when the output signal is in the first state, to connect said one of the plurality of electron emitters to a second voltage connection when the output signal is in the second state, and to disconnect said one of the plurality of electron emitters from the first voltage supply connection and second voltage connection when the output signal is in the third state; and a first register arranged to contain data indicating which of the plurality of outputs should be in the first state and which of the plurality of outputs should be in the second state and a second register arranged to contain data indicating which of the plurality of outputs should be in the third state, wherein the data from the second register is arranged to override that from the first register.

2. The control system of claim 1 further comprising an output monitoring means arranged to monitor each of the plurality of outputs and generate a feedback signal arranged to indicate if any of the plurality of outputs exceeds a predetermined threshold.

3. The control system of claim 1 further comprising an output monitoring means arranged to monitor each of the plurality of outputs and generate a feedback signal arranged to indicate which of the plurality of outputs exceeds the threshold.

4. The control system of claim 1 further comprising an output monitoring means, wherein the output monitoring means is arranged to compare each of the plurality of outputs to a reference signal and produce comparison signals indicating whether said each of the plurality of outputs is greater than the reference signal.

5. The control system of claim 4 wherein the output monitoring means is arranged to combine said comparison signals into a serial output.

6. The control system of claim 5 comprising a feedback register arranged to receive the comparison signals and generate the serial output.

7. The control system of claim 1 further comprising a blanking means arranged to set all of the plurality of outputs in the second state irrespective of which state the input signal indicates they should nominally be in.

8. A control system for an X-ray scanner, the system comprising:

an input arranged to receive an input signal identifying which of a plurality of electron emitters is to be active and to produce a plurality of outputs each arranged to control an operation of one of the plurality of electron emitters, wherein each of the plurality of outputs is configured to be in a first state arranged to activate its respective emitter of the plurality of electron emitters and a second state arranged to de-activate said respective emitter of the plurality of electron emitters; and a blanking means arranged to fix all of the plurality of outputs in the second state irrespective of which state the input signal indicates the plurality of outputs should nominally be in, wherein the control system is configured to be operable in a non-sequential access mode in which the plurality of outputs are configured to be in the first state for a plurality of activation periods and the blanking means is configured to be turned on between the plurality of activation periods to put all of the plurality of outputs in the second state.

9. The control system of claim 8 wherein the system is operable in a sequential access mode in which the blanking means is turned off while each of the outputs is put into the first state in a predetermined sequence.

10. A plurality of control sub-systems for an X-ray scanner, wherein each of the plurality of control sub-systems comprises:

an input arranged to receive an input signal identifying which of a plurality of electron emitters is to be active and to produce a plurality of outputs each arranged to control an operation of one of the plurality of electron emitters, wherein each of the plurality of outputs is configured to be in a first state arranged to activate its respective emitter of the plurality of electron emitters and a second state arranged to de-activate said respective emitter of the plurality of electron emitters; and a blanking means arranged to fix all of the plurality of outputs in the second state irrespective of which state the input signal indicates the plurality of outputs should nominally be in, wherein the blanking means of one of the plurality of control sub-systems is arranged to be turned off while one of the plurality of outputs from said one of the plurality of control sub-systems is in the first state and is arranged to be turned on while one of the plurality of outputs from another of the plurality of control sub-systems is in the first state.

* * * * *